United States Patent [19]

Parizek

[11] 4,038,724

[45] Aug. 2, 1977

[54] SCARF RETAINER AND PENDANT

[76] Inventor: Jaro Parizek, 1 Holiday Park Drive, Williston Park, Long Island, N.Y. 11596

[21] Appl. No.: 720,436

[22] Filed: Sept. 3, 1976

[51] Int. Cl.[2] ..... A41D 25/04
[52] U.S. Cl. ..... 24/49 S; 2/207
[58] Field of Search ..... 24/49, 56; 2/207, 154, 2/155

[56] References Cited

U.S. PATENT DOCUMENTS

| | | | |
|---|---|---|---|
| 686,690 | 11/1901 | Fishel | 24/49 S |
| 3,183,612 | 5/1965 | Romaine | 24/49 S |

*Primary Examiner*—Werner H. Schroeder
*Assistant Examiner*—Doris L. Troutman
*Attorney, Agent, or Firm*—Robert L. Slater, Jr.

[57] ABSTRACT

A friction grip aesthetic pendant for retaining a scarf about the wearer's neck, the scarf ends being held by the pendant in flaired separated positions. The friction grip feature avoids puncture, excessive stress or abrasion of delicate scarf fabrics.

4 Claims, 4 Drawing Figures

SCARF RETAINER AND PENDANT

BACKGROUND OF THE INVENTION

The present invention relates to buckles and clasps and in particular, relates to a scarf pendant for retaining the corners of a scarf in a flaired position when the scarf is placed about the neck of the wearer.

Numerous earlier scarf retainers have been devised for holding the ends of a scarf or neckerchief about the wearer's neck. These earlier devices have for the most part utilized a movable clasp which pierced the scarf fabric or firmly locked into the body of the scarf for support and to prevent slipping. Pulled threads, excessive stress, rapid wear of the scarf fabric where the retainer gripped the scarf fabric often resulted in damage to the fabric.

Some earlier scarf retainers depended upon frictional gripping of the scarf. In these earlier friction retainers, a section of the scarf ends were gathered to form a bulky section then the scarf was forcibly pulled through a single retaining ring or length of tubing. This latter arrangement often placed undue stress on delicate scarf fabrics; wearing and wrinkling of the scarf fabric resulted. The earlier friction retainers bound the scarf ends to hang vertically downward from the scarf retainer. That is, the ends or corners of the scarf remained infolded rather than being held in an unfurled or flaired position.

Present styles, particularly for women, utilize delicate colorful neckerchiefs and short scarfs for color accent on many costumes. To maintain the scarf ends in a flaired position, pins are presently often utilized to pierce the scarf fabric to retain the ends in a flaired position. The delicate fabrics, after a few wearings, show the punctures and may result in pulled threads. None of the presently available scarf retainers provide means free of damage risks to the scarf fabric for holding the scarf corners in flaired, separated positions when place about the wearer's neck.

The delicate neckerchief fabrics in current style usage are best retained about the wearer's neck without knotting but with a retainer device which securely holds in place while not bringing excessive strain upon or severing the threads of the fabric. While numerous devices have been disclosed in times past to retain neckerchiefs about the wearer's neck, none of these earlier devices appear to be without one or more of the disadvantages referred to above for the present style use.

There is, therefore, a need for a scarf or neckerchief retainer which does not pierce or otherwise damage the scarf fabric, and that retains the scarf corners or ends in spaced apart flaired positions when placed about the wearer's neck and provides a secure gripping means free of all excessive stress, wrinkling, wear or punctures to the fabric.

My invention, briefly stated, is a friction grip scarf retainer and pendant comprising the combination of a planar base plate with friction grip means mounted to one face thereof. Wire segments forming respectively a plurality of closed loops in spaced relationships, one to another, comprise the friction grip means. Segments mounted to form two parallel juxtaposed loops at the bottom of the base plate which holds the scarf ends in flaired spaced relationhip, and at least one upper closed loop in cooperation with the aforesaid juxtaposed loops provide frictional gripping between the scarf and the pendant.

DETAILED DESCRIPTION

Figure 1:
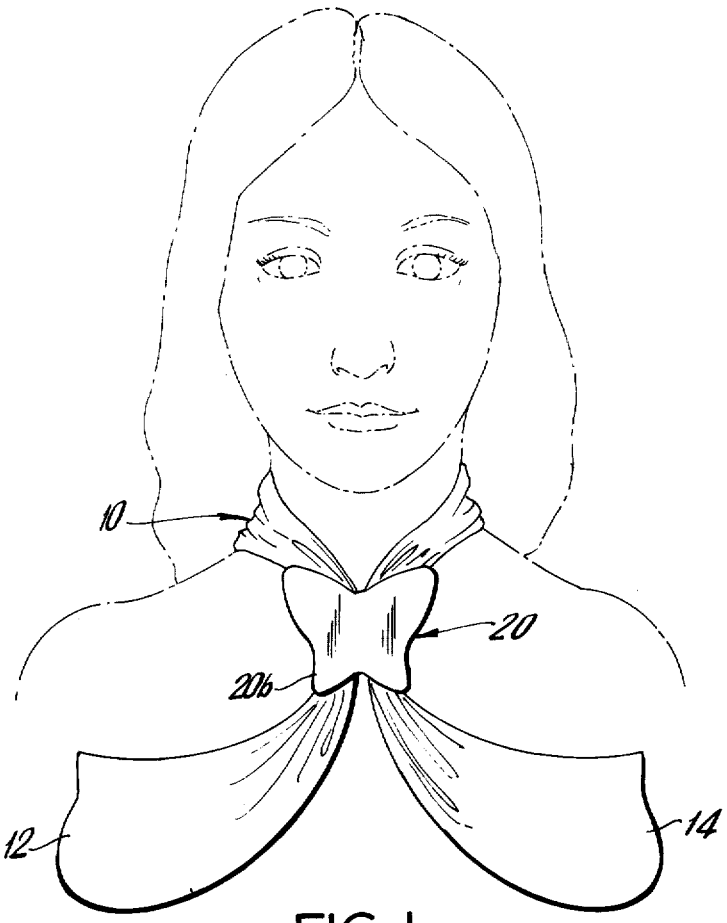
FIG. 1 is a plan view of my scarf retainer and pendant shown with a scarf as normally worn about a person's neck.

Referring now to the illustrations, FIG. 1 shows a scarf or neckerchief 10 placed about the neck of a person. The scarf terminates with ends 12 and 14. My scarf retainer 20 is shown frictionally attached about the scarf, the scarf ends 12 and 14 are shown held in flaired spaced apart positions by the scarf retainer.

The scarf retainer and pendant is comprised of a planar base plate 24. The base plate may have the general contour of a butterfly as is shown in the illustrations or any other convenient aesthetically pleasing contour. The base plate has a front side **24*a* and a rear side 24*b*; it also has a top and a bottom. In the illustrations, FIGS. 1 and 2 show the retainer 20** in the upright position.

A plurality of wire segments are mounted in spaced relationship one to the other onto the rear side **24*b* of the base plate. Wire segments 26 and 28 are mounted at right angles to the rear side 24*b* of the base plate to form parallel juxtaposed closed loops adjacent to the bottom of the base plate 24. The positioning of the closed loops may be more readily visualized by referring to FIG. 2. A wire segment 30 is mounted to the base plate rear surface adjacent to the top thereof to form one larger closed loop. This arrangement is most readily visualized by reference to FIG. 2**.

To attach my scarf retainer and pendant, the wearer places a scarf or neckerchief about her neck, passes both ends 12 and 14 of the scarf through the upper loop formed by wire segment 30; then separating the scarf ends 12 and 14 passes each end separately through the respective loops formed by wire segments 26 and 28. The retainer 20 may be adjusted and the frictional grip tightened in place by sliding the retainer upward on the scarf. The scarf ends 12 and 14 are held in separated unfurled positions by the respective lower loop wire segments 26 and 28.

Figure 2:
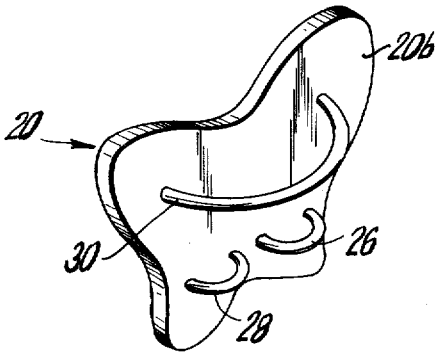
FIG. 2 is a perspective view of the rear side of my novel scarf retainer and pendant invention shown in FIG. 1.
Figure 3:
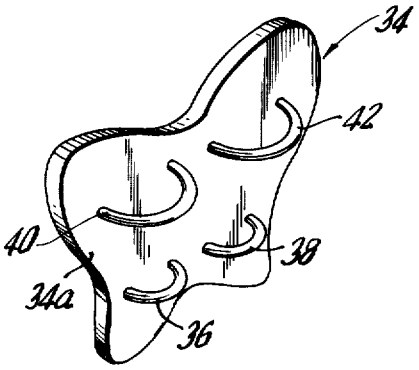
FIG. 3 is a variation of the embodiment of my invention shown in FIGS. 1 and 2.

FIG. 3 illustrates a useful variation on the embodiment of my invention shown in FIGS. 1 and 2. The FIG. 3 embodiment comprises a base plate 34 having a rear side 34a. Wire segments 36 and 38 form two parallel juxtaposed closed loops adjacent to the lower end of the base plate 34. To direct the scarf ends into further spaced apart separation, the FIG. 3 embodiment utilizes two juxtaposed parallel closed loops adjacent to the upper end of the base plate 34. The upper closed loops are formed by wire segments 40 and 42, respectively, then through loops 36 and 38, respectively, the friction gripping action is induced and my scarf retainer and pendant is readily secured in place. Greater friction may be gained to make the friction grip more secure by crossing the scarf ends between the upper loops 40 and 42 and the lower loops 38 and 36, respectively.

Figure 4:
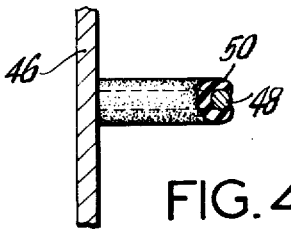
FIG. 4 is a fragmentary view of still another variation of the embodiment of my invention shown in FIGS. 1 and 2.

FIG. 4 illustrates in fragmentary cross section view still another variation on my invention illustrated in FIGS. 1 and 2. A base plate fragment 46 is shown in cross section view with a portion of a wire segment 48 mounted to the base plate at right angles, as described above in connection with FIGS. 1 and 2. The wire segment 48 is covered with a high friction liner 50. A short section of rubber "O" ring may be fitted over the wire section to provide the high friction liner. The friction liner 50 provides an increased friction between the scarf retainer metal wire segment 48 and the scarf fabric. The friction liner is useful when the weight of the base plate and a sculptured design, which the base may bear, is sufficiently large to permit undesired slipping of the retainer on a smooth fabric scarf when the wearer moves about.

I have found, however, that for most models of my scarf retainer of the designs, illustrated in FIGS. 1, 2 and 3 and described above, the friction between the scarf retainer and all but the most polished fabrics is quite adequate to hold them firmly in place during normal wear.

The foregoing illustrations and descriptions of my invention are intended as merely illustrative. Other embodiments, within the intended scope of my invention but not illustrated above, are easily visualized. The intended scope of my invention is defined by the following claims.

I claim:

1. A friction grip pendant for retaining the corners of a scarf positioned about a wearer's neck in separated flaired relationship comprising the combination of a planar base plate having front and rear sides and top and bottom ends, a plurality of wire segments, the segments being fixedly mounted in spaced relationship, one to another, to the rear side of the base plate at right angles thereto, each segment when mounted to the base plate forming, respectively, a closed loop, the segments being mounted to form two parallel juxtaposed loops adjacent to the bottom end of the base plate, at least one segment being mounted to form a closed loop adjacent to the top end of the base plate, whereby the pendant may be frictionally suspended and the scarf ends retained in spaced apart flaired positions by passing the scarf corners through the upper, then separately, through the bottom parallel adjacent loops whereupon the scarf may be retained by the bottom loops when the scarf ends are pulled respectively into separated flaired positions.

2. The friction grip pendant of claim 1 wherein one segment is mounted to form a closed loop adjacent to the top of the base plate.

3. The friction grip pendant of claim 1 wherein two segments are mounted in juxtaposed parallel relationship adjacent to the top of the base plate.

4. The friction grip pendant of claim 1 wherein the wire segments are covered with a rubber high friction liner.

* * * * *